US009235170B2

(12) United States Patent
Yura et al.

(10) Patent No.: US 9,235,170 B2
(45) Date of Patent: Jan. 12, 2016

(54) IMAGE FORMING APPARATUS CAPABLE OF OBTAINING GOOD FIXED CONDITION REGARDLESS OF TYPE OF GRADATION SEQUENCE PROCESSING

(75) Inventors: Jun Yura, Kanagawa (JP); Hiroyuki Sugiyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 229 days.

(21) Appl. No.: 13/285,711

(22) Filed: Oct. 31, 2011

(65) Prior Publication Data

US 2012/0114359 A1 May 10, 2012

(30) Foreign Application Priority Data

Nov. 4, 2010 (JP) ..... 2010-247494

(51) Int. Cl.
*G03G 15/20* (2006.01)
*G03G 15/04* (2006.01)

(52) U.S. Cl.
CPC ..... *G03G 15/2039* (2013.01); *G03G 15/2078* (2013.01); *G03G 15/04027* (2013.01); *G03G 2215/0132* (2013.01)

(58) Field of Classification Search
CPC ..... G03G 15/04027; G03G 15/2078; G03G 15/5087
USPC ..... 399/69, 70, 181; 358/3.01, 3.06, 3.21
See application file for complete search history.

(56) References Cited

U.S. PATENT DOCUMENTS 5,708,949 A 1/1998 Kasahara et al.
6,559,421 B1 5/2003 Yura et al.
6,631,253 B2 10/2003 Nakafuji et al.
6,636,718 B2 10/2003 Yura et al.
6,646,227 B2 11/2003 Yura et al.
6,795,676 B2 9/2004 Kikuchi et al.
6,795,678 B2 9/2004 Yura et al.
6,847,792 B2 1/2005 Nakafuji et al.
6,897,409 B2 5/2005 Yura et al.
6,941,088 B2 9/2005 Atsushi et al.
7,010,255 B2 3/2006 Yura et al.
7,058,330 B2 6/2006 Nakafuji et al.
7,107,681 B2 9/2006 Yura et al.
7,212,753 B2 5/2007 Suzuki et
7,218,879 B2 5/2007 Enoki et al.
7,224,928 B2 5/2007 Kikuchi et al.

(Continued)

FOREIGN PATENT DOCUMENTS

JP 1-267582 10/1989
JP 4-156490 5/1992

(Continued)

*Primary Examiner* — David Gray
*Assistant Examiner* — Laura Roth
(74) *Attorney, Agent, or Firm* — Oblon, McClelland, Maier & Neustadt, L.L.P.

(57) ABSTRACT

An image forming apparatus comprises an image information obtainer that obtains image information, a gradation sequence processor that applies multiple types of gradation sequence processing to the image information, and a toner image formation device that forms a toner image based on the image information. A fixing device is provided to fix the toner image onto a recording medium in a fixing process. A temperature controller is also provided to change a start-up temperature of the fixing device before the fixing process. The start-up temperature is changed in accordance with inclusion of a halftone process and a type of the gradation sequence processing applied to the image information.

15 Claims, 10 Drawing Sheets

(56) References Cited

U.S. PATENT DOCUMENTS

| | | | | |
|---|---|---|---|---|
| 7,251,429 | B2 | 7/2007 | Nakafuji et al. | |
| 7,315,711 | B2 | 1/2008 | Ariizumi et al. | |
| 7,346,305 | B2 | 3/2008 | Kikuchi et al. | |
| 7,620,336 | B2 | 11/2009 | Yura et al. | |
| 7,693,471 | B2 | 4/2010 | Kikuchi et al. | |
| 7,941,075 | B2 | 5/2011 | Shiraishi et al. | |
| 2002/0031362 | A1* | 3/2002 | Baba | 399/69 |
| 2005/0088697 | A1* | 4/2005 | Yasutomi et al. | |
| 2006/0127144 | A1* | 6/2006 | Watanabe | |
| 2007/0224528 | A1 | 9/2007 | Yamashita et al. | |
| 2008/0124106 | A1 | 5/2008 | Enoki et al. | |
| 2010/0021195 | A1 | 1/2010 | Yura et al. | |
| 2010/0046994 | A1 | 2/2010 | Kikuchi et al. | |
| 2010/0098446 | A1 | 4/2010 | Ishikawa et al. | |
| 2010/0278558 | A1 | 11/2010 | Enoki et al. | |
| 2011/0044739 | A1* | 2/2011 | Kim et al. | |
| 2011/0217061 | A1* | 9/2011 | Ichikawa et al. | 399/69 |
| 2011/0229232 | A1 | 9/2011 | Kojima et al. | |
| 2012/0114358 | A1* | 5/2012 | Sugiyama et al. | 399/69 |

FOREIGN PATENT DOCUMENTS

| | | | | |
|---|---|---|---|---|
| JP | 6-161196 | | 6/1994 | |
| JP | 7-319238 | | 12/1995 | |
| JP | 07314783 | A * | 12/1995 | B41J 2/485 |
| JP | 8-278725 | | 10/1996 | |
| JP | 9-197911 | | 7/1997 | |
| JP | 2005-111899 | A | 4/2005 | |
| JP | 2005-321549 | A | 11/2005 | |
| JP | 2006-133580 | | 5/2006 | |
| JP | 2006-191294 | A | 7/2006 | |
| JP | 2008158167 | A * | 7/2008 | |
| JP | 2008-185638 | | 8/2008 | |
| JP | 2008-268784 | | 11/2008 | |
| JP | 2010-176011 | A | 8/2010 | |
| JP | 2010176001 | A * | 8/2010 | |

* cited by examiner

FIG. 4

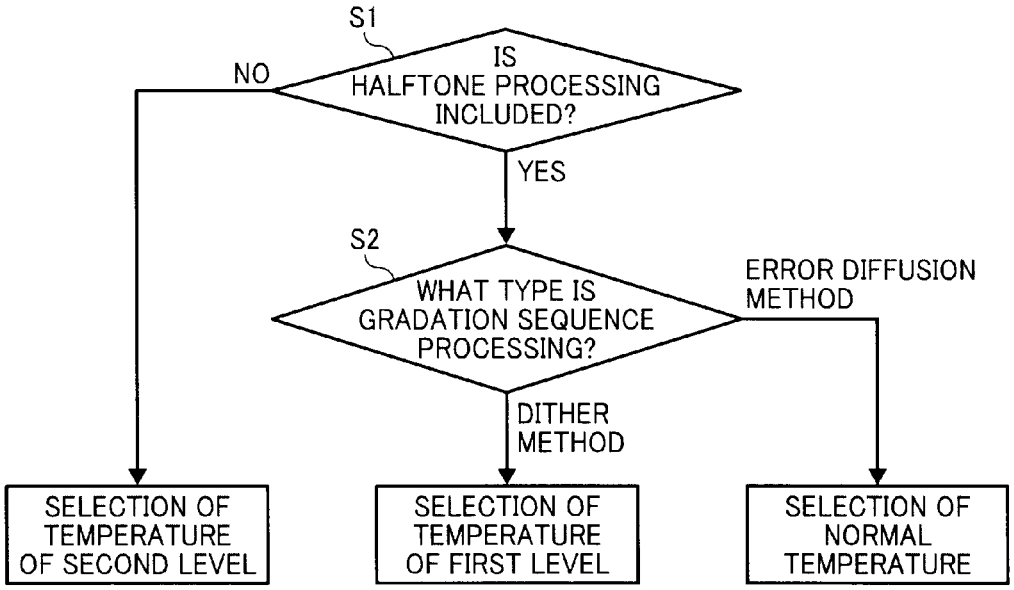

FIG. 5

| | IMAGE FORMATION MODE | PHOTOGRAPHIC REGION | CHARACTER REGION |
|---|---|---|---|
| PRINTING | ORDINARY DOCUMENT (PRIORITY ON SPEED) | CONCENTRATION 150 [lpi] | CONCENTRATION 200[lpi] |
| | ORDINARY DOCUMENT (PRIORITY ON IMAGE QUALITY) | LINE SCREEN 150 [lpi] | DECENTRATION 300[lpi] |
| | PHOTOGRAPH (PRIORITY ON IMAGE QUALITY) | LINE SCREEN 200 [lpi] | DECENTRATION 300[lpi] |
| | HIGH RESOLUTION | LINE SCREEN 250 [lpi] | DECENTRATION 600[lpi] |
| COPYING | | ERROR DIFFUSION | |

| NUMBER OF LINES [lpi] | DITHER TYPE | | |
|---|---|---|---|
| | CONCENTRATION | SCREEN LINE | DECENTRATION |
| 150 | TEMPERATURE OF FIRST LEVEL | TEMPERATURE OF FIRST LEVEL | TEMPERATURE OF FIRST LEVEL |
| 200 | TEMPERATURE OF FIRST LEVEL | TEMPERATURE OF FIRST LEVEL | NORMAL TEMPERATURE |
| 250 | NORMAL TEMPERATURE | NORMAL TEMPERATURE | NORMAL TEMPERATURE |
| 300 | NORMAL TEMPERATURE | NORMAL TEMPERATURE | NORMAL TEMPERATURE |

FIG. 8

| IMAGE FORMATION MODE | PHOTOGRAPH REGION | | CHARACTER REGION | |
|---|---|---|---|---|
| | IMAGE LESS THAN 100% IS INCLUDED | ONLY 100% IMAGE | IMAGE LESS THAN 100% IS INCLUDED | ONLY 100% IMAGE |
| ORDINARY DOCUMENT (PRIORITY ON SPEED) | TEMPERATURE OF FIRST LEVEL | TEMPERATURE OF SECOND LEVEL | TEMPERATURE OF FIRST LEVEL | TEMPERATURE OF SECOND LEVEL |
| ORDINARY DOCUMENT (PRIORITY ON IMAGE QUALITY) | TEMPERATURE OF FIRST LEVEL | TEMPERATURE OF SECOND LEVEL | NORMAL TEMPERATURE | TEMPERATURE OF SECOND LEVEL |
| PHOTOGRAPH (PRIORITY ON IMAGE QUALITY) | TEMPERATURE OF FIRST LEVEL | TEMPERATURE OF SECOND LEVEL | NORMAL TEMPERATURE | TEMPERATURE OF SECOND LEVEL |
| HIGH RESOLUTION | NORMAL TEMPERATURE | NORMAL TEMPERATURE | NORMAL TEMPERATURE | NORMAL TEMPERATURE |

IMAGE FORMING APPARATUS CAPABLE OF OBTAINING GOOD FIXED CONDITION REGARDLESS OF TYPE OF GRADATION SEQUENCE PROCESSING

CROSS-REFERENCE TO RELATED APPLICATIONS

This patent application is based on and claims priority pursuant to 35 U.S.C. §119 to Japanese Patent Application No. 2010-247494, filed on Nov. 4, 2010, the entire disclosure of which is hereby incorporated by reference herein.

FIELD OF THE INVENTION

The present invention relates to an image forming apparatus, such as a copier, a printer, a facsimile machine, a multifunctional machine combining these devices, etc.

BACKGROUND OF THE INVENTION

In electrophotographic image forming apparatuses, such as copiers, printers, facsimile machines, multifunctional machines formed by combining these devices, etc., there is generally provided a fixing device to fuse and fix toner (i.e., developer) onto a recording medium sheet. In such a fixing device, a prescribed temperature often referred to as a fixing temperature is needed for fixing an unfixed toner image, and accordingly is set in advance.

However, the fixing temperature varies depending on the type of toner image and/or recording medium used. Typically, the conditions that cause the fixing temperature to vary include density of toner attracted onto a sheet or the number of isolated toner dots attracted thereto and the like. When relatively large numbers of isolated toner dots are attracted onto a sheet and accordingly a printing rate is relatively high, the fixing temperature generally needs to be higher than when relatively small numbers of isolated toner dots are attracted thereonto, and accordingly the printing rate is relatively low. For this reason, the fixing temperature in conventional image forming apparatuses is set using the most difficult conditions for fixing the toner onto the recording medium.

However, when a fixing operation is executed under such a worst-case scenario even in a situation in which fixing can be carried out easily, the fixing temperature is maintained at an unnecessarily high level, thereby wasting power in a heating system and going against recent energy saving trend.

Further, such a problem relates not only to the fixing temperature of an actual fixing operation but also to that of a start-up temperature for preheating the fixing device executed before starting the fixing operation. Specifically, if the start-up temperature is decreased, energy can be saved by reducing the power to be supplied to the fixing device before start of the fixing operation.

Further, a sleep mode is increasingly employed in an image forming apparatus these days, to be entered immediately after completion of printing as a start-up time period needed before starting up the fixing device decreases. Accordingly, the start-up time period increasingly impacts energy saving.

Japanese Patent No. 3,295,273 (JP-3295273-B) describes a technology capable of changing a start-up time period for starting up a fixing device in accordance with a difference in image resolution between a character mode and a photographic mode. With such a technology, the start-up time can be shortened in the character mode due to its low resolution (i.e., favorableness to fixed condition), thereby further minimizing energy consumption in comparison with a situation in which the start-up time is invariably long.

However, various factors impact the fixed conditions of a toner image beside the resolution thereof. For example, since a dot shape differs depending on the type of gradation sequence processing used, fixing performance is significantly impacted by the type thereof. Accordingly, if the start-up temperature is controlled only based on the resolution of the image as described in JP-3295273-B, no large energy savings can be expected.

BRIEF SUMMARY OF THE INVENTION

Accordingly, the present invention provides a novel image forming apparatus that comprises an image information obtainer that obtains image information, a gradation sequence processor that applies multiple types of gradation sequence processing to the image information, and a toner image formation device that forms a toner image based on the image information. A fixing device is provided to fix the toner image onto a recording medium in a fixing process. A temperature controller is also provided to change a start-up temperature of the fixing device before the fixing process. The start-up temperature is changed in accordance with inclusion of a halftone process and the type of gradation sequence processing having been applied to the image information.

In another aspect, one of the multiple types of gradation sequence processing includes multiple types of dither methods. The start-up temperature is changed further in accordance with the type of dither method having been applied to the image information and the number of lines thereof when one of the multiple types of dither methods is employed.

In another aspect, the image information obtainer includes a copying unit to read the image information from an original document and output a copying result based thereon and a printing unit to receive the image information from outside and output a printing result based thereon. The gradation sequence processor applies an error diffusion method and a dither method to the image information when the copying and the printing units output copying and printing results, respectively. The dither method has multiple types of dithering.

In yet another aspect, the start-up temperature is designated to be lower when one of the multiple types of dither methods is applied to the image information than when the error diffusion method is applied thereto.

In yet another aspect, an image formation condition changer is provided to change a condition of one of resolution of an image and the number of steps of a diameter of an image dot (to be generated based on the image information). The type of dither method and the number of lines employed therein are changed in accordance with the image formation condition changed by the image formation condition changer.

In yet another aspect, a region detector is provided to detect inclusion of one of character and photographic regions on an image. The type of dither method and the number of lines employed therein are changed in accordance with a detection result obtained by the region detector.

BRIEF DESCRIPTION OF THE SEVERAL VIEWS OF THE DRAWINGS

A complete appreciation of the present invention and many of the attendant advantages thereof will be more readily obtained as the same becomes better understood by reference to the following detailed description when considered in connection with the accompanying drawings, wherein:

FIG. 4 is a flowchart illustrating a control sequence of controlling a start-up temperature of a fixing device in the first embodiment;

FIG. 5 specifically illustrates a type of a dither method and the number of lines in photograph and character regions in each of multiple image formation modes;

FIG. 8 illustrates a start-up temperature per image formation mode in accordance with presence and absence of photograph and character regions and a halftone image;

DETAILED DESCRIPTION OF THE INVENTION

Figure 1:
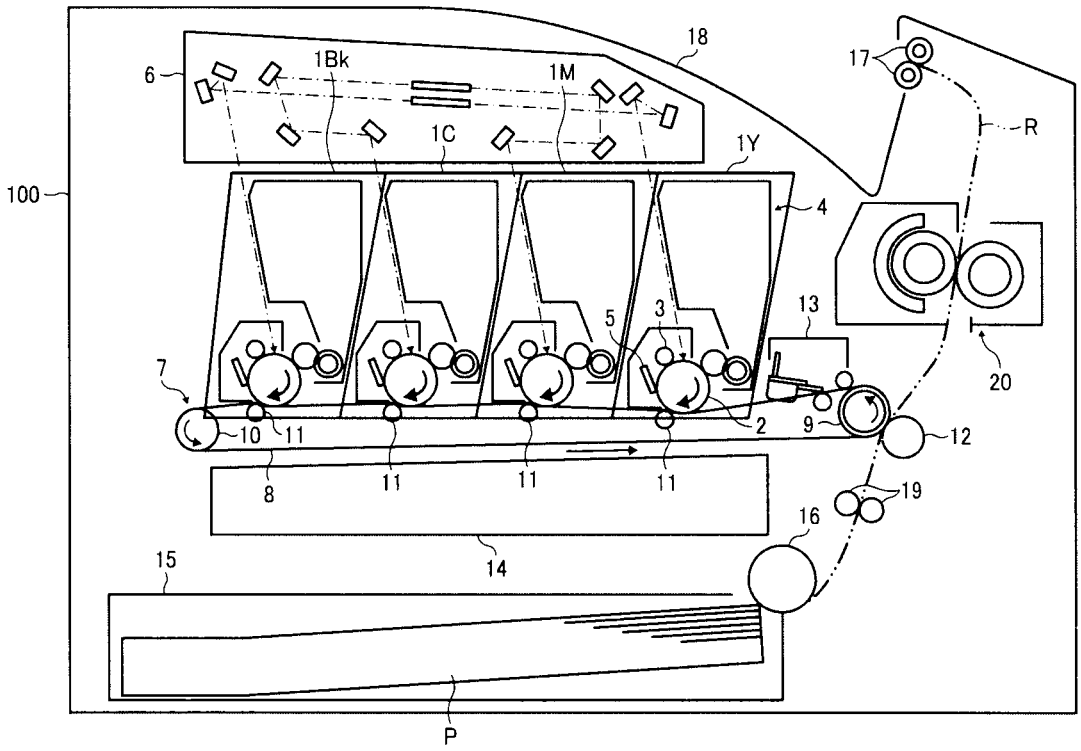
FIG. 1 is a cross sectional view schematically illustrating a configuration of an image forming apparatus according to a first embodiment of the present invention.

Referring now to the drawings, wherein like reference numerals designate identical or corresponding parts throughout the several views thereof, and in particular to FIG. 1, a laser color printer provided as an image forming apparatus is described. As shown, four process units 1Y, 1M, 1C, and 1K are detachably attached to a body 100 of the image forming apparatus as image formation units. Each of the four process units 1Y, 1M, 1C, and 1K includes the same configuration storing toner of different component colors of Yellow, Magenta, Cyan, and Black (Y, M, C, and K) collectively forming a color image.

Specifically, each of the respective process units 1Y, 1M, 1C, and 1K includes a drum type photoconductive unit 2 as an image bearer, a charger having a charge roller 3 or the like for charging a surface of the photoconductive drum 2, and a developing device 4 for supplying toner (i.e., developer) onto the surface of the photoconductive unit 2. Also included in each of the respective process units 1Y, 1M, 1C, and 1K is a photoconductive unit cleaning blade 5 or the like for cleaning the surface thereof.

As shown in FIG. 1, above the respective process units 1*y*, 1*m*, 1*c*, and 1*k*, there is provided an exposure 6 for exposing the surface of the photoconductive units 2 to a light. The exposure 6 includes a light source, a polygon mirror, an f-θ lens, and a reflection mirror or the like, and emits a laser light to the surface of the respective photoconductive units 2 in accordance with image data.

Further, below the respective process units 1*y*, 1*m*, 1*c*, and 1*k*, there is provided a transfer device 7 including an endless intermediate transfer belt 8 as a transfer unit. The transfer device 7 is stretched by driving and driven rollers 9 and 10 collectively forming a supporting unit and runs and circulates in a direction as shown by an arrow in the drawing when the driving roller 9 rotates counter clockwise therein.

At positions opposed to the four photoconductive units 2, there are provided four primary transfer rollers 11 internally pressing against the intermediate transfer belt 8, respectively, as primary transfer devices. Thus, four primary transfer nips are formed where the intermediate transfer belt 8 is depressed and contacts the respective photoconductive units 2. The respective primary transfer rollers 11 are connected to a power source, not shown, to receive impression of a prescribed direct current voltage and/or alternating current voltage therefrom.

Further, at a position opposed to the driving roller 9, there is provided a secondary transfer roller 12 as a secondary transfer device pressing against an outer circumference surface of the intermediate transfer belt 8 to form a secondary transfer nip at a contact thereon. Similar to the primary transfer rollers 11, the secondary transfer roller 12 is connected to a power supply, not shown, to receive impression of a prescribed direct current voltage and/or alternating current voltage therefrom.

Further, at the right side end on the outer circumferential surface of the intermediate transfer belt 8 in the drawing, there is provided a belt cleaner 13 to clean the surface of the intermediate transfer belt 8. A waste toner conveyance hose pipe, not shown, is provided below the transfer device 7 with its one end connected to the belt cleaner 13 and the other end being connected to an inlet provided in the waste toner container 14.

At a lower section of the apparatus body 100, there is provided a sheet feeding cassette 15 accommodating sheet like recording medium P, such as a paper sheet, an OHP (Over Head Projector) sheet, etc. A sheet feeding roller 16 is provided in the sheet feeding cassette 15 to launch the recording medium P therefrom. Above the apparatus body 100, there are provided a pair of sheet ejection rollers 17 and a sheet ejection tray 18 to eject the recording medium P outside the apparatus body 100 and stocks the thus ejected recording medium P thereon.

Inside the apparatus body 100, there is provided a conveyance path R to convey the recording medium P from the sheet feeding cassette 15 to the sheet ejection tray 18 via the secondary transfer nip. On the conveyance path R, a pair of registration rollers 19 are provided upstream of the secondary transfer roller 12 in a conveyance direction of the recording medium P. Further, a fixing device 20 is also provided down stream of the second transfer roller 12 in the direction.

Now, with reference to FIG. 1, a fundamental operation of the above-described image forming apparatus is described. When image formation is started, the photoconductive unit 2 in each of the process units 1*y*, 1*m*, 1*c*, and 1*k* is driven and rotated clockwise in the drawing, so that the surface thereof is uniformly charged by the charge roller 3 to have a prescribed polarity. In accordance with image information of an original document read by a reader, not shown, a laser light of each of component colors of Yellow, Magenta, Cyan, and Black collectively forming a full-color image when superimposed is emitted from the exposure 6 to a charged surface of the corresponding photoconductive unit 2, so that a latent image of a corresponding component color is formed thereon. Subsequently, the developing device 4 supplies toner and visualizes the latent image on the photoconductive unit 2 as a toner image.

The driving roller 9 stretching the intermediate transfer belt 8 is driven and rotated, so that the intermediate transfer belt 8 is circulated in a direction as shown by an arrow in the drawing. At the same time, a prescribed voltage subjected to constant voltage or current control and having an opposite polarity to that of electric charge of toner is applied to each of the primary transfer rollers 11. Consequently, transfer electric fields are created at the primary transfer nips between the primary transfer rollers 11 and the photoconductive units 2, respectively. Subsequently, toner images of respective component colors borne on the photoconductive units 2 are transferred and superimposed one after another on the intermediate transfer belt 8 at the primary transfer nips by the transfer electric fields created thereon. Hence, the intermediate transfer belt 8 carries a full-color toner image on its surface. The residual toner not transferred onto the intermediate transfer belt 8 remaining on the respective photoconductive units 2 are then removed by the cleaning blades 5 therefrom, respectively.

Further, as the image formation starts, the sheet feeding roller 16 rotates and launches the recording medium P from the sheet feeding cassette 15. The recording medium P is then conveyed by the pair of registration rollers 19 toward the secondary transfer nip created between the secondary transfer roller 12 and the intermediate transfer belt 8 at a prescribed time period. At that moment, a transfer voltage having an opposite polarity to that of electric charge of toner of the toner image born on the intermediate transfer belt 8 is applied to the secondary transfer roller 12, so that a transfer electric field is created at the secondary transfer nip. Subsequently, the toner image on the intermediate transfer belt 8 is transferred onto the recording medium P in a block under the transfer electric field created at the secondary transfer nip. Then, the recording medium P is subsequently conveyed to the fixing device 20 and the toner image is fixed therein onto the recording medium P. Subsequently, the recording medium P is ejected onto the sheet ejection tray 18 by the pair of sheet ejection rollers 17.

Further, beside the above-described full-color image formation system, prescribed less than four process units 1Y, 1M, 1C, and 1K are utilized to form a monochrome, a bicolor, and/or a tricolor image.

Figure 2:
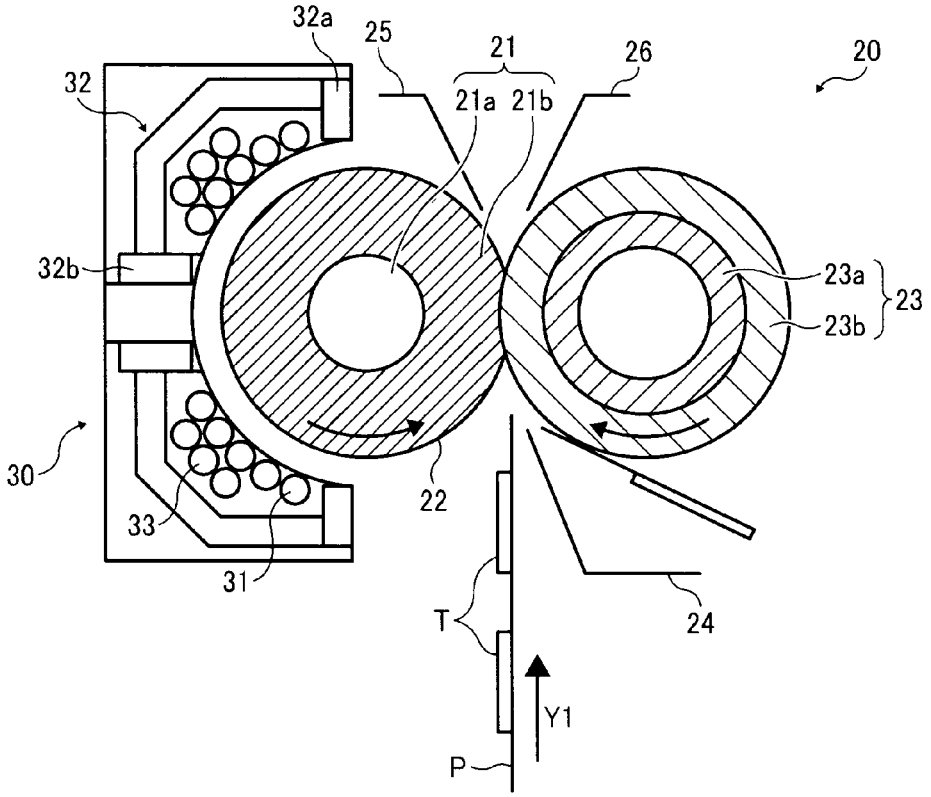
FIG. 2 is a cross sectional view schematically illustrating a configuration of a fixing device installed in the image forming apparatus of FIG. 1.

Now, a configuration and an operation of the fixing device are described with reference to FIG. 2. The fixing device 20 includes a fixing sleeve 22 that fixes an unfixed image T borne on the recording medium P as a fixing unit, a fixing roller 21 that holds the fixing sleeve 22 as a holder, and an induction heater 30 that heats the fixing sleeve 22 as a heater. Further included in the fixing device 20 is a pressing roller 23 or the like that presses against the fixing sleeve 22 as a pressing unit.

The fixing sleeve 22 is formed from a substrate made of metal having thickness of from about 30 micrometer to about 50 micrometer, an elastic layer overlying the substrate, and a mold releasing layer overlying the elastic layer, totally having a diameter of about 40 mm. The substrate of the fixing sleeve 22 can be made of magnetic metal material, such as iron, cobalt, nickel, alloy of these material, etc. The elastic layer of the fixing sleeve 22 can be made of silicon rubber having a thickness of about 150 micrometer. Hence, heat capacity is not that large, while a fine uniformly fixed image can be obtained. Further, the mold releasing layer is a tube state coat made of fluorine chemical compound, such as PFA, etc., having a thickness of about 50 micrometer. The mold releasing layer is utilized to improve mold releasing performance of toner from the surface of the fixing sleeve where the toner image T directly contacts the same.

The fixing roller 21 is formed from a core metal 21*a* made of metal material, such as stainless steel, etc., and a heat resistant elastic layer 21*b* made of silicone foam material overlying the metal core 21*a*, having an outer diameter of about 40 mm. The elastic layer 21*b* has a thickness of about 9 mm including Asker hardness of from about 30 degrees to about 50 degrees at its axis. The fixing roller 21 engages an inner circumferential surface of the thin fixing sleeve 22 to keep it in a roller state.

The pressing roller 23 is formed from a core metal 23*a* made of high heat conductive metal material, such as aluminum, copper, etc., a heat resistant elastic layer 23*b* made of such as silicone, etc., overlying the metal core 23*a*, and a mold releasing layer, not shown, overlying the heat resistant elastic layer 23*b*, totally having an outer diameter of about 40 mm. The elastic roller 23*b* is formed to have a thickness of about 2 mm. The mold releasing layer is a coat of a PFA tube having a thickness of about 50 micrometer. The pressing roller 23 presses against the fixing roller 21 via the fixing sleeve 22 forming a nip at a pressure contacting section therebetween through which the recording medium P passes.

The induction heater 30 includes a magnetic exciting coil 31, a core unit 32, and a demagnetization coil 33 or the like. The magnetic exciting coil 31 is extended in its widthwise direction (i.e., perpendicular to a plane of the drawing of FIG. 2). The magnetic exciting coil 31 is formed from a coil guide partially covering an external circumference of the fixing sleeve and a litz wire having a bundle of thin lines winding around the coil guide. The demagnetic coil 33 is arranged symmetrically (e.g. in a recording medium widthwise direction) overlying the magnetic exciting coil 31. The core unit 32 is made of ferromagnetic unit, such as ferrite, etc., having a relative magnetic permeability of about 2,500 degrees and is provided with a center core 32*b* and a side core 32*a* so as to generate an effective magnetic flux toward the fixing sleeve 22.

The core unit 32 is opposed to the magnetic exciting coil 31 extending widthwise.

Now, an operation of the thus configured fixing device 20 is described more in detail. When the pressing roller 23 is driven and rotated by a driving motor, not shown, clockwise in FIG. 2, the fixing sleeve 22 is also driven and rotated counter clockwise at the same time. At that moment, the fixing roller 21 holding the fixing sleeve 22 is not positively driven and rotated, and the fixing sleeve 22 is heated up to serve as a heat generator by a magnetic flux generated by the induction heater 30 at a position opposed thereto.

Specifically, an alternating current of a high frequency wave having from about 10 kHz to 1 MHz, more preferably from about 20 kHz to 800 kHz, is flown from a power supply, not shown, into the magnetic exciting coil 31, so that a magnetic line is generated while switching its polarity in both directions in the vicinity of the fixing sleeve that is opposed to the magnetic exciting coil 31. Thus, since the alternating magnetic field is formed, eddy current and accordingly Joule heat is generated in the substrate (i.e., a heat generation layer) of the fixing sleeve 22 due to its electric resistance, thereby heating the fixing sleeve 22 by its own due to heat induction.

The surface of the fixing sleeve 22 heated by the induction heater 30 reaches a nip created with the pressing roller 23, and heats and fuses an unfixed toner image T borne on the recording medium P conveyed thereto.

Specifically, the recording medium P carrying the toner image T having been subjected to the above-described image formation process is then conveyed between the fixing sleeve and the pressing roller 23 being guided by a guide plate 24 in a conveyance direction as shown by an arrow Y1. The toner image T is then fixed onto the recording medium P by heat and pressure applied by the fixing sleeve 22 and pressing roller 23, respectively. Subsequently, the recording medium P is separated from the fixing sleeve 22 by a fixing section separation plate 245 and a pressure separation plate 26, thereby being fed out of the nip. The surface of the fixing sleeve 22 passing through the nip reaches a position opposed to the induction heater 30.

Now, a first embodiment of the present invention is described. A controller, such as a CPU, etc., installed in an image forming apparatus of one embodiment of the present invention includes a gradation sequence processor for applying gradation processing to image information, and a start-up temperature changer for changing a start-up temperature of a fixing device before a fixing process starts therein. Such a start-up temperature enables the fixing device to increase its temperature to a prescribed level before the fixing process.

Now, a change in temperature of a fixing sleeve (i.e., a fixing unit) according to the first embodiment is described with reference to FIG. 3. As shown, a heating mode for heating the fixing sleeve includes a start-up mode, a rotation mode before sheet feeding (herein after simply referred to as a previous rotation mode), and a sheet feeding mode executed in this order in turn after a power supply is turned on. In each of such respective heating modes, a heat target temperature and respective rotation speeds of the fixing sleeve and the pressing roller are separately designated. The previous rotation mode is executed before the sheet feeding mode to rotate both of the fixing sleeve and the pressing roller slower than those in the sheet feeding mode in order to heat those at higher temperature than that in the sheet feeding mode thereby suppressing despoiling of the temperature of the fixing sleeve while minimizing drop of the temperature during the coming sheet feeding mode.

Figure 3:
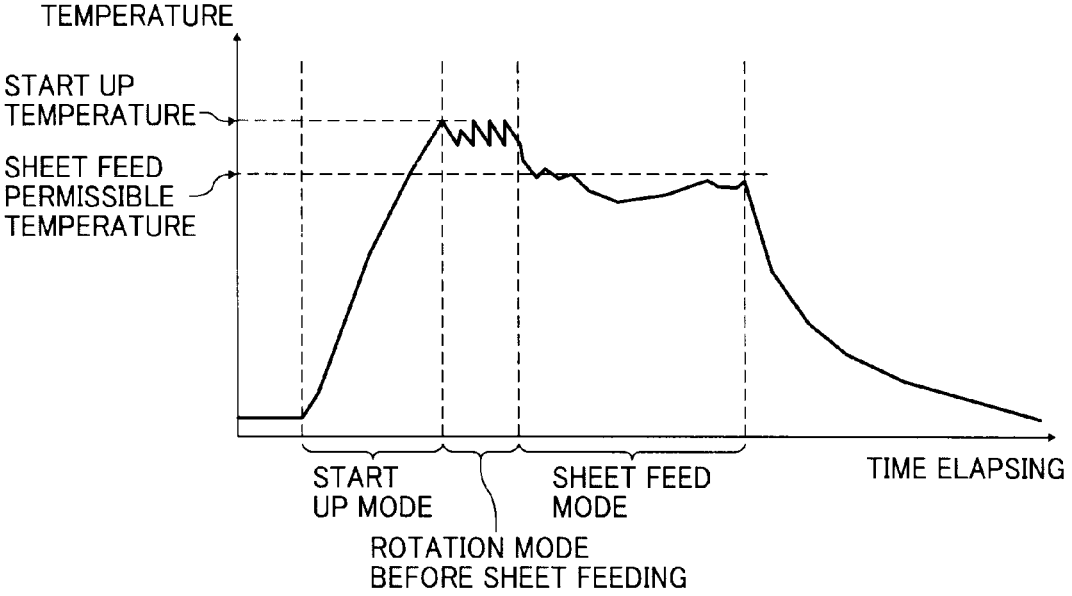
FIG. 3 schematically illustrates a change in temperature of a fixing sleeve included in the fixing device of the first embodiment.

The start-up temperature of FIG. 3 represents a setting temperature needed for the fixing sleeve when the start-up mode is shifted to the previous rotation mode. The start-up temperature can be changed by the start-up temperature changer. Further, a sheet feed permission temperature in the drawing represents a setting temperature needed for the fixing sleeve when the previous rotation mode is shifted to the sheet-feeding mode.

Further, as a gradation process, a dither method and an error diffusion method are utilized in this embodiment. The dither method represents a dark and light image with binary (i.e., black and white). Specifically, similar to ordinal binarization, binarization is appropriately executed based on prescribed variable thresholds so that a binarized image can be remotely seen as having the dark and light of black and white. Further, the error diffusion method is capable of smoothly representing an image by utilizing a halftone process. Specifically, in the method, an error generated in processing a pixel of a digital image is allocated to surrounding pixels, and repeats processing in consideration of an impact of the previous allocation of the error to minimize the total error.

Further, the start-up temperature has three levels to be chosen by the start-up temperature changer. In general, a prescribed start-up temperature enabling to suppress a fixing error or the like even though a most unfavorable image to be fixed is used is designated on condition that the same type of a recording medium P is used. In this respect, a normal temperature (i.e., a first start-up temperature) is provided in this embodiment to represent the above-described prescribed start-up temperature to be designated for the most unfavorable image. A level slightly lower than the normal temperature is also provided in this embodiment as a first level temperature (i.e., a second start-up temperature). A level widely lower than the normal temperature is also represented as a second level temperature (i.e., a third start-up temperature) in this embodiment. For example, the first and second level temperatures are lower than the normal temperature by 5 and 10 degrees centigrade, respectively.

Now, with reference to FIG. 4, a control sequence controlling start-up temperature in the first embodiment is described more in detail. Initially, it is determined if an image to be formed on a recording medium conveyed to the fixing device (i.e., a recording medium firstly supplied thereto during consecutive printing) includes halftone processing (i.e., halftone) per value of component colors of C, M, Y, and K in step S1. Specifically, when a personal computer instructs printing, printer image processing converts values of RGB (0 to 100%) on a display into those of C, M, Y, and K (0 to 100%) so that an engine can draw an image per page. At that moment, inclusion of the halftone processing is determined based on the values of the C, M, Y, and K. When the determination is negative (i.e., No) as a result, for example K=100%, a lower start-up temperature can be chosen, because such a solid image generally has favorable fixed condition. Accordingly, when the determination is negative as above, the second level temperature widely lower than the normal temperature is chosen.

By contrast, when the determination is positive (i.e., K=0 to 99%), start-up temperature is inhibited to widely decrease due to its unfavorable condition to fixed condition. Therefore, further determination is executed to identify a type of gradation sequence processing used in image formation in step S2. Specifically, when the error diffusion manner is used as a halftone processing system, a lot of toner particles are isolated forming small dots on the recording medium and is likely peeled off therefrom after completion of printing unless sufficiently fused by sufficiently high temperature. Accordingly, if a result of the determination represents the error diffusion method, the normal temperature is chosen due to impossibility of decreasing the start-up temperature.

Further, when a dither method is used, since gradation sequence is expressed by drawing a line, the number of isolated dots decreases to be less than that in the error diffusion method on the recording medium. However, it is more unfavorable in comparison with the above-described situation omitting the halftone processing. Therefore, when the determination shows the dither method, a temperature of the first level is chosen. Hence, according to this embodiment, one of the start-up temperature levels is chosen to execute the above-described start-up mode based on the choosing result.

Now, another control manner according to a second embodiment of the present invention is described. In this embodiment, a gradation processing manner is selectively used in accordance with a kind of an image forming system, i.e., a manner of inputting and outputting image information. Specifically, image information received from an external system, such as a personal computer, etc., and supposed to be outputted by a printer is subjected to a type of gradation processing other than that for image information read from an original document supposed to be outputted by a copier as described below. In short, a prescribed dither method is used for the printer, and a prescribed error diffusion method is used for the copier. Further, when the printing output is used, plural image formation modes are provided to change one of resolution of an image to be fixed and the number of steps of a diameter of an image dot for prescribed purposes. Specifically, the resolution of the image is changed by changing the number of dots per unit area (i.e., dot density), such as 600 dpi (dot per inch), 1,200 dpi, etc. The number of steps of a diameter of an image dot is changed by changing the number of bits. There are provided various image formation modes in the printing output in this embodiment which include a speed priority general document mode that gives priority on speed, a quality priority general document mode that gives priority on image quality, a photograph mode that also gives priority on image quality, and a high resolution mode. The resolution and the number of steps of an image dot diameter are respectively designated as 600 dpi and 1 bit, 600 dpi and 2 bit, 600 dpi and 4 bit, and 1200 dpi and 1 bit, in the speed quality general document mode, the quality priority general document mode, the photograph mode, and the high resolution mode.

The speed priority general document mode is advantageous to productivity and only needs a short time period for image processing even generating a prominent saw tooth character and/or line due to a small number of lines. The image quality priority general document mode generates a character region with diffusion dithering and has a greater number of lines than the speed priority general document mode. This image quality priority general document mode more suppresses the saw tooth characters in comparison with the speed priority general document mode, and generates a photograph region with line dithering and suppresses color unevenness. However, since image quality is given priority, productivity degrades in comparison with the speed priority general document mode due to taking a longer time period starting from a data input ending at printing completion or the like. Whereas in the photograph (image quality priority) mode, since a photograph region has yet greater number of lines than that in the image quality priority general document mode, a finer (higher) resolution image can be obtained improving granularity. Further, in the high resolution mode, since photograph and character regions have yet greater number of lines than that in the photograph (image quality priority), the resolution level is highest in this embodiment with sharp characters and lines.

The respective modes are switched by a user through an operation of a control panel provided on the apparatus body. However, a sheet type detector can be provided to automatically detect a type of a sheet, so that the modes can be changed in accordance with detection information indicating a type of sheet as a detection result.

Further, the image forming apparatus of this embodiment includes a region detector for (separately) detecting character and photograph regions on an image. Then, a type of dithering and the number of lines are changed in each of the above-described four image formation modes in accordance with a detection result of the region detector (i.e., either the character region or the photograph region) as listed on a table in FIG. 5

Further, it has been known that a halftone image having a lot of isolated dots generates unfavorable fixed condition. However, such fixed condition of the halftone image largely fluctuates in accordance with a type of dithering to write as described below in detail with reference to FIG. 6.

As shown, fixed condition of a halftone image per type of dithering is described. Plural halftone images are outputted using various halftone processing manners and are evaluated. Eleven samples of the halftone images are prepared having density of from about 0.5 to about 1.0 (ID) at every interval of about 0.05, by using X-rite 938 manufactured by X-Rite, Incorporated. Further, about 130, about 140, and about 150 degrees centigrade of temperature are used to fix the samples.

Subsequently, smear fixed condition is evaluated per sample, which is one of determining manners of fixed condition of a copying/printing image by showing peeling off tendency of toner from a halftone image as described below.

Specifically, a halftone sample having a base density (ID) of about 0.75±0.1 when measured by the spectral density sensor manufactured by X-Rite Incorporated is rubbed by reciprocating a white cotton cloth five times under a prescribed amount of load. Subsequently, density of a section where the toner is attracted onto the white cotton cloth is measured by the spectral density sensor. Then, it is recognized that as the density of the section of the white cotton cloth increases, evaluation of the fixed condition becomes worse, because the toner becomes readily peeled off from recording medium. At this moment, the highest smear ID value obtained from the samples heated under the same fixing temperature having the same image processing information is regarded as a smear ID value of fixed condition in this gradation processing. Such information is plotted on a graph with its vertical axis representing a smear ID value and its lateral axis representing fixing temperature per type of gradation processing. As recognized from the drawing, as the smear ID increases, the fixed condition becomes worse.

Figures 6, 7:
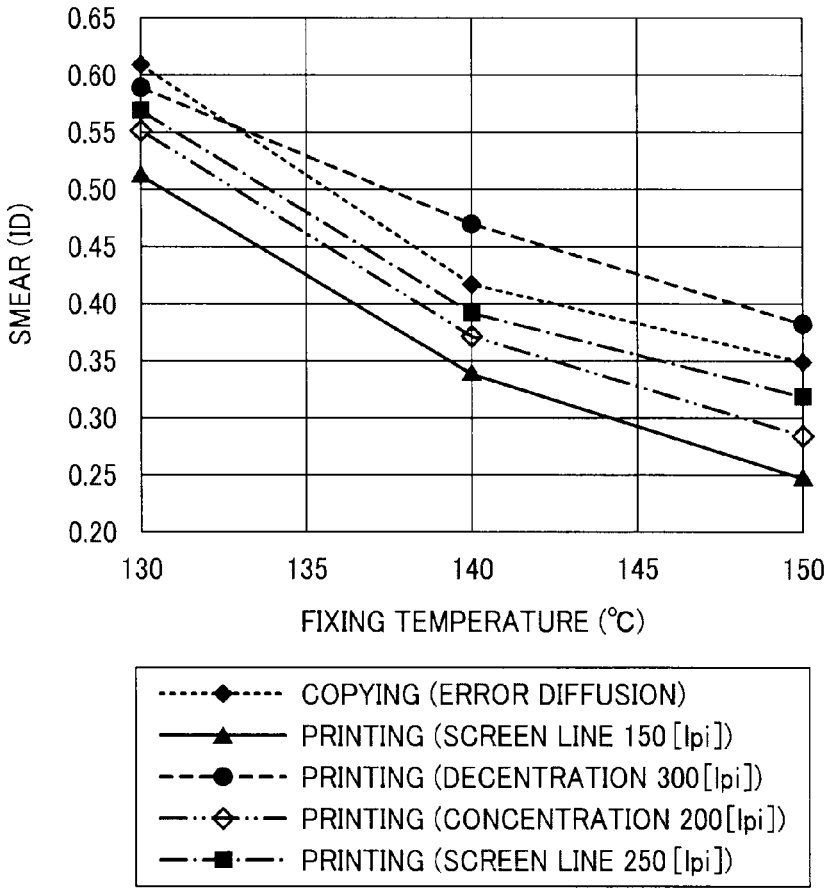
FIG. 6 illustrates fixed condition of a halftone image obtained per type of dithering.
FIG. 7 illustrates a start-up temperature to be chosen in accordance with a type of dithering and the number of lines when a dither method is used as a gradation sequence process.

As shown in FIG. 6, almost all of the dithering types show better fixed condition than the error diffusion method in the printing output (mode). However, fixed condition of a diffusion dithering frequently used for character or the like is worse in a printing output (mode) than in the copying output (mode). Accordingly, quality of the fixed condition is not determined only based on a single factor such as a printing output (mode) or a copying output (mode). Accordingly, it is preferable to control fixing temperature in accordance with fixed condition of each of the output images.

Then, according to a second embodiment, a start-up temperature is controlled in accordance with a type of dithering and the number of lines when a dither method is used as gradation processing in addition to the above-described sequence control of the first embodiment.

FIG. 7 illustrates degrees of start-up temperature to be chosen in accordance with a type of dithering and the number of lines when a dither method is used as a gradation sequence processing manner, which is obtained based on the consideration with reference to a graph of FIG. 6. A normal temperature and temperature of a first level are the same as described above, respectively. When concentration dithering and line dithering are used with the number of lines being less than 200 [lpi], start-up temperature is decreased down to the first level. Further, when diffusion dithering is used with the number of lines being greater than 200 [lpi], start-up temperature is not decreased lower than the normal temperature level.

FIG. 8 illustrates degrees of start-up temperature obtained with reference to FIGS. 5 and 7 to be designated in accordance with an image formation mode, presence and absence of photograph and character regions, and that of a halftone image. In the drawing, absence of the halftone image is represented by "100% image only", and presence thereof, "presence of image less than 100%", respectively.

Figure 9:
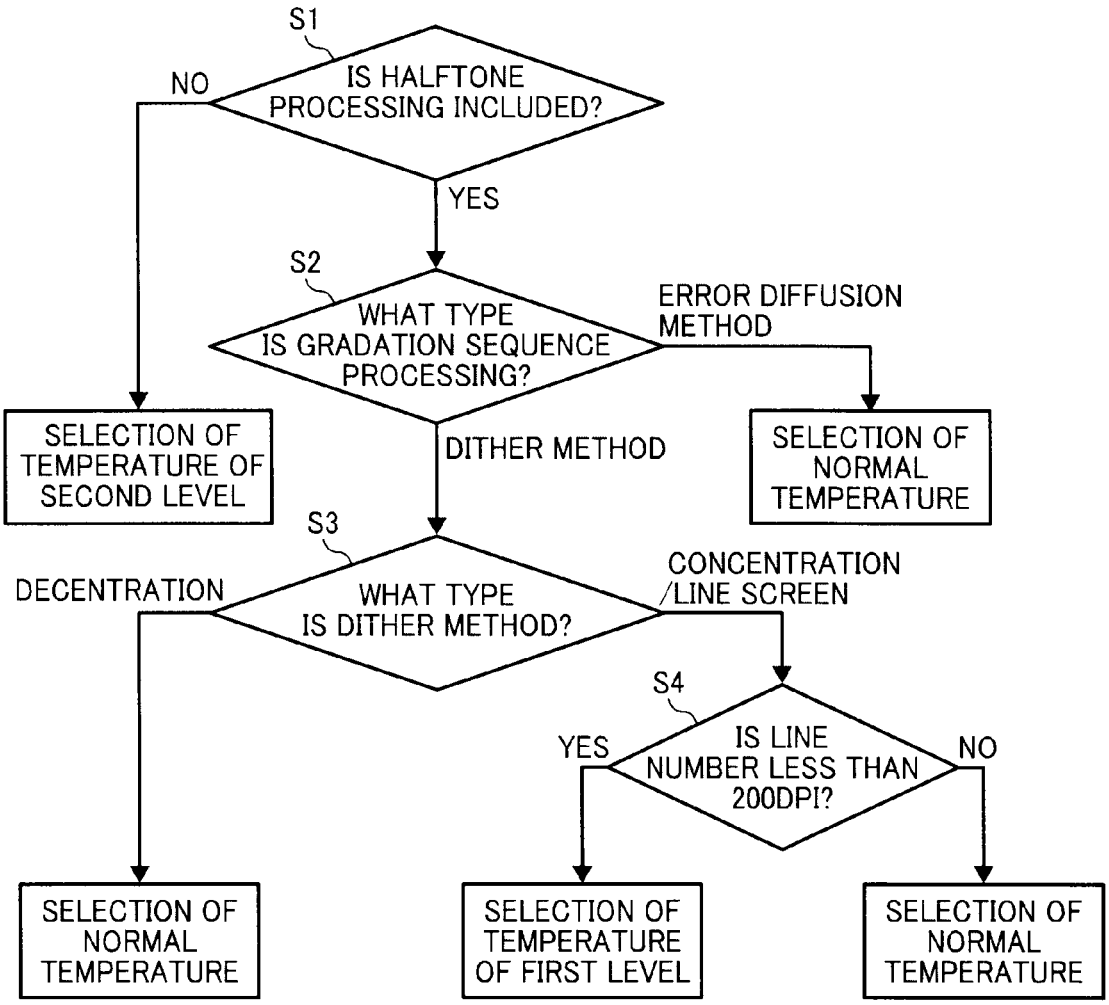
FIG. 9 is a flowchart illustrating a control sequence of controlling start-up temperature according to a second embodiment of the present invention.

Now, a start-up temperature control sequence of the second embodiment is described in detail with reference to FIG. 9. Similar to the first embodiment, the start-up temperature has three levels of normal temperature, temperature of a first level, and temperature of a second level. Since steps S1 and S2 of FIG. 9 in this embodiment are the same as those in FIG. 4 of the first embodiment, description thereof is not repeated, and only the rest of steps are herein below described. In step S2, when it is determined that a gradation processing type is a dither method, a type of dithering is then determined in step S3. If the determination indicates that a diffusion dithering has been used, a normal temperature is chosen. Because, the diffusion dithering is not favorable to fixed condition in comparison with the other types of dithering (e.g. concentration dithering, line dithering) even though the number of lines is the same, and accordingly start-up temperature is inhibited to decrease.

Whereas if the determination indicates that dithering, such as concentration dithering, line dithering, etc., other than the diffusion dithering has been used, the number of lines are further determined in step S4. As a result, it is determined that the number of lines is less than 200 [lpi], temperature of a first level slightly less than the normal one is chosen, because such a condition is relatively favorable to fixed condition. By contrast, when the number of lines is determined as equal to or greater than 200 [lpi], the normal temperature is chosen because the condition is unfavorable to the fixed condition. Hence, prescribed temperature is appropriately chosen to execute heating based thereon.

Figure 10:
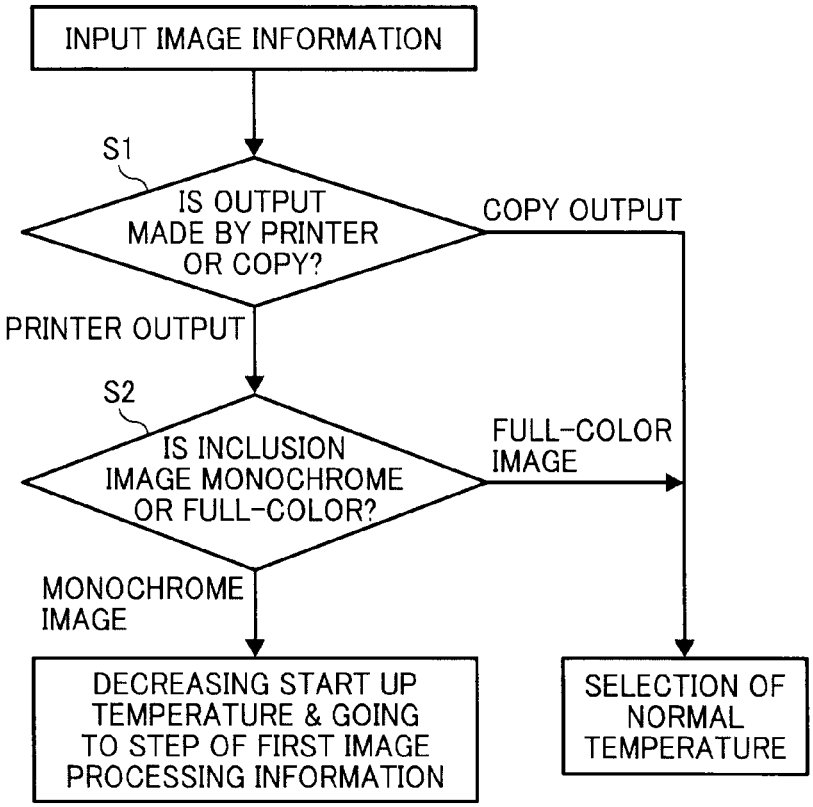
FIG. 10 is a flowchart illustrating a control sequence of controlling start-up temperature according to a third embodiment of the present invention.

Now, a control manner according to a third embodiment is described with reference to FIGS. 10 to 12. In this embodiment, a prescribed degree of start-up temperature is chosen additionally based on determination if an image is monochrome or full-color and inclusion of character and photograph regions beside the above-described various conditions as described below in detail.

Also in this embodiment, as similar to the first and second embodiments, the start-up temperature has three levels of a normal temperature, a temperature of a first level, and a temperature of a second level. As shown in FIG. 10, it is initially determined which one of a printing output and a copying output is requested based on an input of image information in step S1. As in the earlier described embodiment, a diffusion method is used in this embodiment for the printing output, whereas an error diffusion method, for the copying output, respectively. Specifically, by identifying one of the printing output and the copying output, a type of gradation processing is determined. As a result, if the determination is the copying output, since the error diffusion method has been used, the start-up temperature is inhibited to decrease and the normal temperature is chosen as described above. Even though the error diffusion method is used as a gradation sequence manner, the start-up temperature can be controlled in accordance with a size of a dot, or a presence of halftone and the like.

Whereas if the determination represents designation of the printing output, it is further determined if the image is either monochrome or full-color in step S2. If the monochrome image is formed, since a dither method has been used as a type of gradation sequence processing, determination if a start-up temperature can be decreased than the normal temperature in accordance with a type of dithering and the number of lines is subsequently executed by acquiring the next first image processing information. That is, a lower limit of a fixing temperature for a monochrome image is predetermined based on smear fixed condition, and there exists an halftone image having a small number of isolated dots depending on a type of dithering, such as line dithering, concentration dithering, etc. Accordingly, when smear fixed condition of such halftone image (having such small numbers of isolated dots) is favorable to the fixed condition, the start-up temperature can possibly be decreased.

Further, a dither method is also used as a gradation sequence processing manner in forming a full-color image. Hewer, since more than two component color toner particles are possibly superimposed in the full-color image more than the monochrome image, and accordingly an amount of attracted toner increases and solid drawing fixed condition or color offset serve as limiting factors other than the smear fixed condition, start-up temperature control is not executed for the full-color image information in this embodiment. Accordingly, if it is determined that the determination is the full-color image, the normal temperature is chosen.

Figure 11:
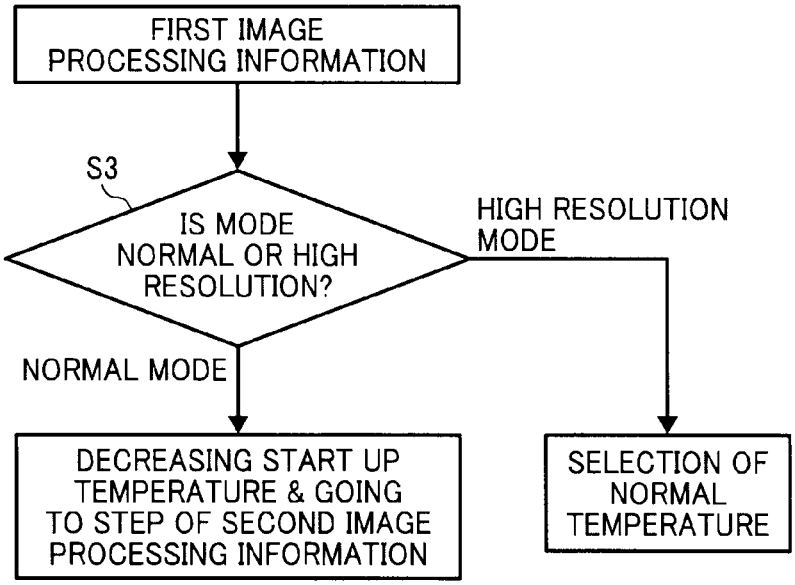
FIG. 11 is a flowchart illustrating a control sequence of controlling start-up temperature according to a fourth embodiment of the present invention.

Now, with reference to FIG. 11, a step of determination if a start-up temperature can be decreased lower than the normal temperature for the above-described monochrome image is executed by acquiring the first image processing information is described. As shown, it is determined in this step S3 if an image is to be formed is a normal mode or a high resolution mode in accordance with first image processing information, wherein the high resolution mode represents the same as the above-described high resolution mode, and the normal mode represents the other modes of the above-described speed priority general document mode, image quality priority general document mode, and the photograph mode described with reference to FIG. 5.

If the determination shows the high resolution mode, since the number of lines is great, the normal temperature is chosen without decreasing the start-up temperature. However, even if the determination represents the high resolution mode, a start-up temperature can be decreased when a presence of halftone is determined and is absent. Whereas, when the determination shows the normal mode, since a start-up temperature can be decreased, the next second image processing information is acquired and determination is made based thereon.

Figure 12:
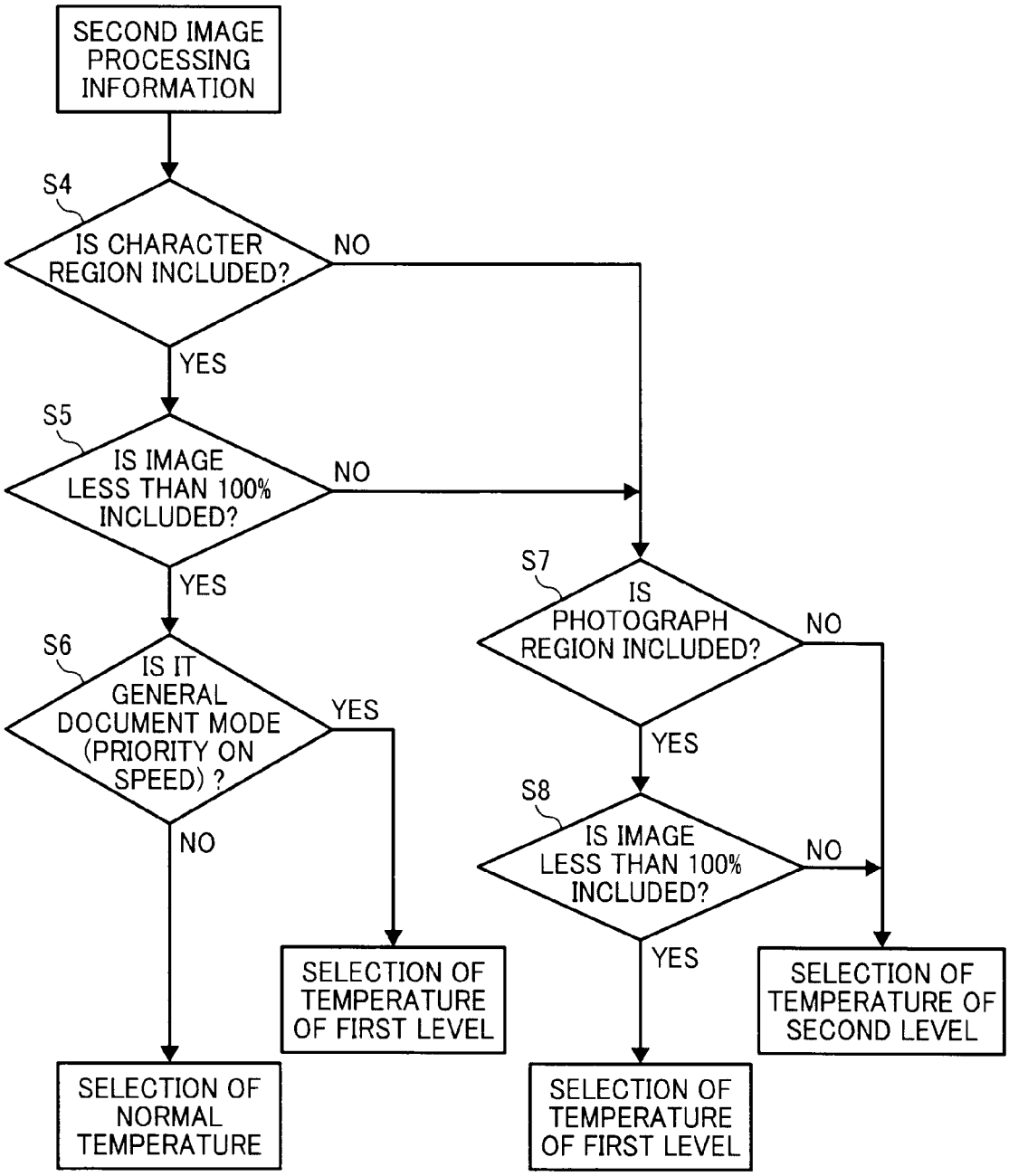
FIG. 12 is a flowchart illustrating a control sequence of controlling start-up temperature according to a fifth embodiment of the present invention.

With reference to FIG. 12, a step of determining if a start-up temperature can be decreased lower than a degree of a normal temperature in an ordinary mode by acquiring second image processing information is described. As shown, it is initially determined if there exists a character region in step S4. If the determination is positive (Yes, in step S4), it is then determined if there exists an image of less than 100% (i.e. halftone processing) in step S5. If the determination is positive (Yes, in step S5), it is further determined if a mode corresponds to the speed priority general document mode in step S6.

Here, the concentration dithering is similarly used as described earlier in the speed priority general document mode, and the diffusion dithering is used in each of the quality priority and photograph modes as shown in FIG. 5. Accordingly, when an image includes a character region and an image of less than 100%, and the speed priority general document mode is designated, since the concentration dithering generating a small number of isolated dots is used, the start-up temperature can be decreased, thereby a temperature of the first level is chosen. By contrast, when an image includes a character region and an image of less than 100% while a mode other than the speed priority general document mode is designated, since the diffusion dithering unfavorable to fixed condition is used, the start-up temperature is inhibited to decrease, thereby the normal temperature is chosen.

Further, in steps S4 and S5, when an image does not include a character region or an image of less than 100%, it is further determined if there exists a photograph region in step S7. If the determination is positive (Yes, in step S7), it is further determined if there exists an image of less than 100% in step S8. If the image includes the photograph region and an image of less than 100%, since the line dithering generating a small number of isolated (toner) dots is used (see FIG. 5), the start-up temperature can be decreased by some degree, thereby a temperature of temperature of the first level is chosen. By contrast, in steps S7 and S8, when an image does not include a photograph region or an image of less than 100%, a temperature of the second level is chosen. Because, in such a situation, since there does not exist the halftone image but exists a solid image of 100%, an allowance of fixed condition increases and a temperature can be widely decreased. Again, it is determined per component color of C, M, Y, and K if an image includes a 100% solid image.

Now, a manner of determining a type of dithering according to one embodiment of the present invention is described with reference to FIG. 13 that illustrates PDL (page-description language) software. As shown, the PDL soft includes a parser unit 301 that executes syntactic parsing per type of a PDL, such as a PS, a PCL, a RPCS of Ricoh Co, Ltd., etc., and a drawing core unit 302 that forms an image of the PDL. The drawing core unit 302 includes a drawing module I/F unit 303 that receives drawing data, such as text, image, vector graphics, etc., and drawing setting information, such as color, transmission settings, etc., an intermediate data storage control unit 304 that stores the drawing data and the drawing setting information in a memory 305, and multiple drawing processing units 500 that execute rendering of the drawing data into output image data. The PDL parser unit 301 obtains dither information to be used from an environment, such as ROM region, etc., when starting up and provides it to the drawing core unit 302.

Figure 13:
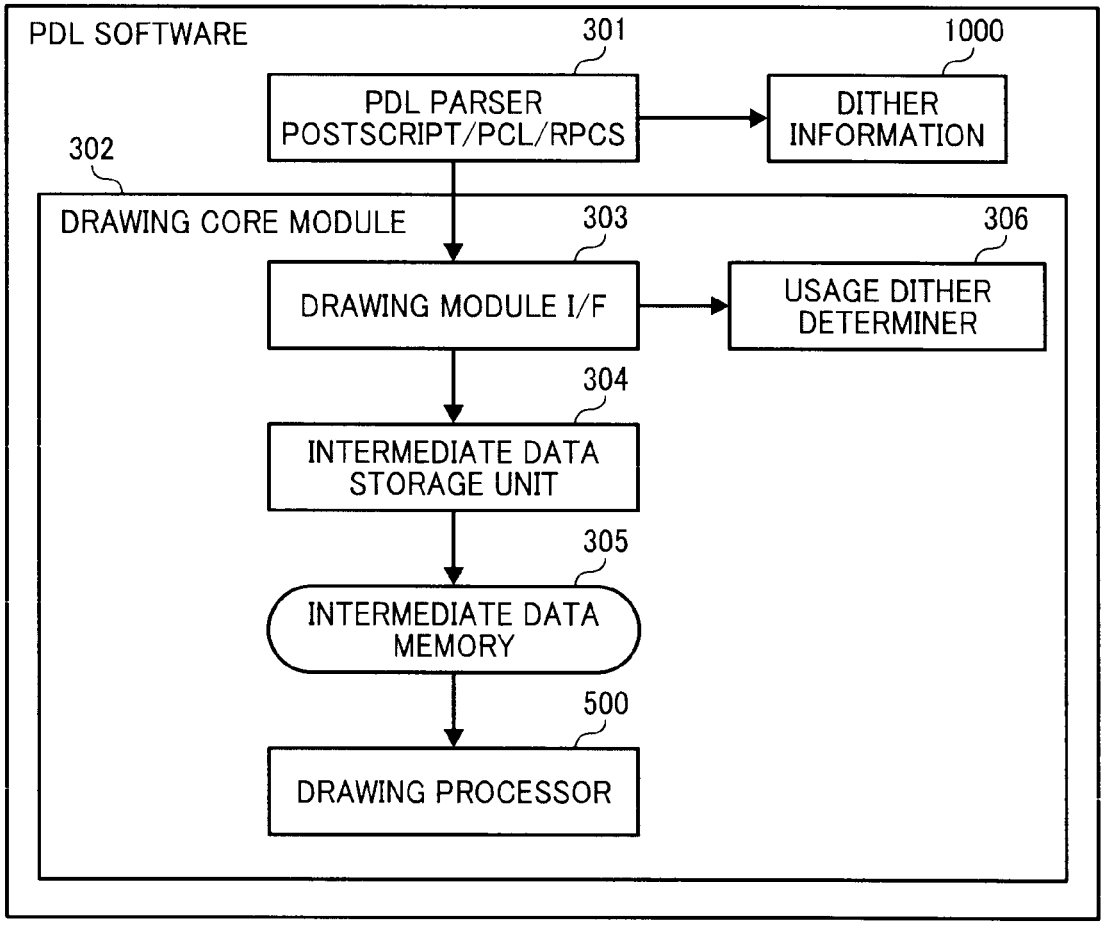
FIG. 13 illustrates PDL software.

Now, a manner of controlling a fixing temperature for a prescribed page is described also with reference to FIG. 13. First, it is supposed that print data transmitted to a controller from a driver installed in a host personal computer include jobs as units. One of the jobs is formed from one or more pages each having one or more bands. The job includes a drawing command and information for setting. A typical drawing command includes character, figure, and an image. Also included in the job are a command for setting a drawing color and that for setting resolution of a page. The PDL parser 301 receives and separates printing data into a drawing command and the like, and then transmits the separation result to the drawing module I/F 303. A usage dither determination unit 306 capable of receiving information from the drawing module I/F 303 chooses dither ID to be used in this page among dither information previously provided to use in this environment based on prescribed setting information, such as resolution of a page, a depth thereof, etc. Subsequently, a prescribed drawing color is designated. Further, when a drawing command I/F in the drawing module I/F 303 is called up, a plane and density of dithering to be used at drawing target coordinates of the drawing command are fixed. Such a usage dithering determination unit 306 is sometimes included in the drawing module I/F 303. Since fixing temperature information is determined when the dither ID, the plane, and the density are fixed, fixing temperature information is obtained for the drawing command.

Figure 14:
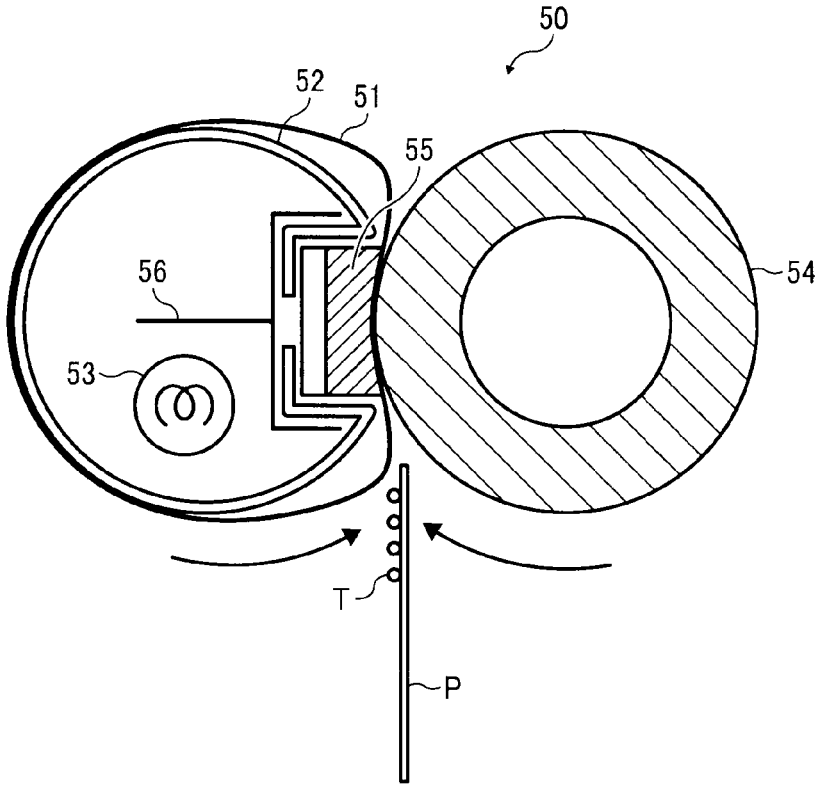
FIG. 14 is a cross sectional view schematically illustrating a configuration of another fixing device to which the various embodiments of the present invention can be applied.

Now, another fixing device capable of adopting a configuration of various embodiments of the present invention is described with reference to FIG. 14. As shown, this fixing device 50 includes an endless fixing belt 51 that fixes an unfixed image T carried on a recording medium P thereto, a metal pipe that supports an inner surface of the fixing belt 51 as a supporter, and a heater that heats the fixing belt 51. Also included are a pressing roller 54 that presses against the fixing belt 51 from an outside thereof, a nip creating unit 55 arranged at an inside of a circle of the fixing belt 51 while engaging with the pressing roller 54 via the fixing belt 51 to create a nip, and an auxiliary hardware status 56.

The fixing belt 51 is formed from a substrate made of SUS or nickel and a surface layer made of silicone rubber and PFA overlying the substrate. The metal pipe 52 also includes a substrate made of SUS or nickel and preferably fluorine slide coating on its circumferential surface contacting the fixing belt. The pressing roller 54 includes a metal core and an elastic layer made of silicone rubber overlying a circumferential surface of the metal core. The nip creating unit 55 is formed from fluorine rubber or the like wrapped around by a PTFE sheet and the like Thus, when the heater generates heat, the metal pipe 52 is heated. Accordingly, temperature of the fixing belt 51 increases. Thus, when the temperature of the fixing belt 51 reaches to a target level and the recording medium P carrying the unfixed toner image T thereon passes through the fixing nip between the rotating fixing belt 51 and the pressing roller 54, the unfixed toner image T is fuse onto the recording medium P. When the temperature of the fixing belt decreases due to the above-described fixing operation, the fixing belt is heated again by the heater 53.

Figure 15:
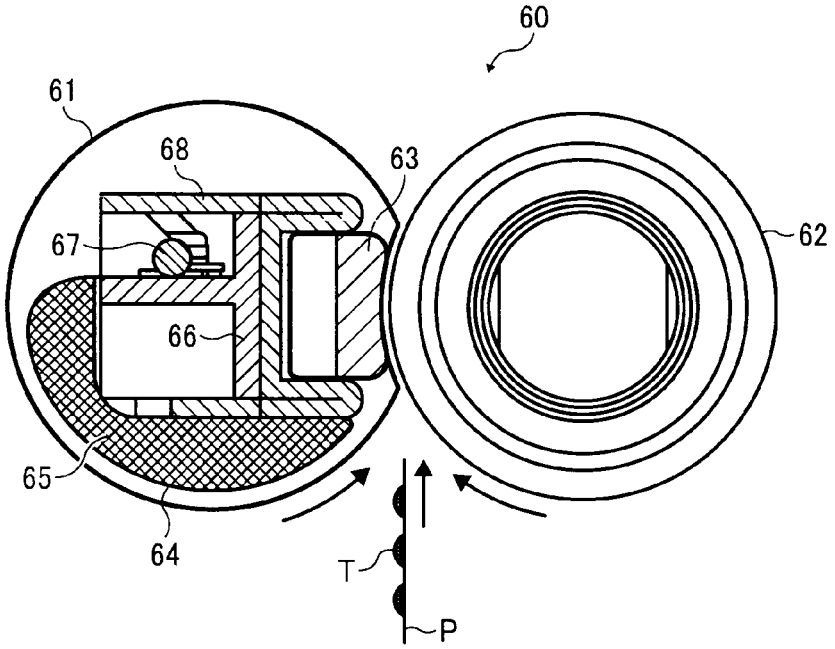
FIG. 15 is a cross sectional view schematically illustrating a configuration of yet another fixing device to which the various embodiments of the present invention can be applied.

Now, yet another fixing device is described with reference to FIG. 15. As shown, this fixing device 60 includes a fixing sleeve 61 as a fixing unit, a pressing roller 62 that presses against the fixing sleeve 61, and a nip creating unit 63 arranged at an inside of a circle of the fixing sleeve 61 engaging with the pressing roller 62 via the fixing sleeve 61 to create a nip. Also included are a planar heat generator 64 that heats the fixing belt 61 and a heat generator supporter 65 that supports the planar heat generator 64 at a prescribed position. Further, a terminal block hardware status 66, a power supply line, and a core holder 68 are provided for prescribed purposes as in FIG. 15.

The planar heat generator 64 includes a flexible film unit and a resistive element heat generator installed in the flexible film unit. Such a planar heat generator 64 is arranged to engage an inner circumferential surface of the fixing sleeve 61 to directly heat thereof. However, the planar heat generator 64 can be arranged adjacent to the fixing sleeve 61. Thus, when the temperature of the fixing sleeve 61 reaches to a target level and the recording medium P carrying the unfixed toner image T passes thereon through the fixing nip between the rotating fixing sleeve 61 and the pressing roller 62, the unfixed toner image T is fused onto the recording medium P.

The other type of a fixing device can be employed. For example, instead of the pressing roller, a pressing belt can be utilized. An additional heater can be employed to heat the pressing roller. The image forming apparatus is not limited to the above-described color laser printer, and can include the other type of a printer, a copier, a facsimile, and a multifunctional machine having functions of those devices.

Hence, according to one embodiment of the present invention, by adjusting a start-up temperature in accordance with inclusion of halftone processing and a type of gradation sequence processing used, an optimum start-up temperature can be designated while widely saving energy. Specifically, the image forming apparatus of the first embodiment comprises an image information obtainer that obtains image information, a gradation sequence processor that applies multiple types of gradation sequence processing to the image information, and a toner image formation device that forms a toner image based on the image information. A fixing device is provided to fix the toner image onto a recording medium in a fixing process. A temperature controller is also provided to change a start-up temperature of the fixing device before the fixing process. The start-up temperature is changed in accordance with inclusion of a halftone process and a type of the gradation sequence processing having been applied to the image information.

Further, as in the second and third embodiments, by combining various factors such as a type of dither, the number of lines, etc., temperature can be precisely controlled in accordance with various conditions further saving energy. Specifically, one of the multiple types of gradation sequence processing includes multiple types of a dither method. The start-up temperature is changed further in accordance with the type of the dither method having been applied to the image information and the number of lines thereof when one of the multiple types of dither method is employed.

Further, the image information obtainer includes a copying unit to read the image information from an original document and output a copying result based thereon and a printing unit to receive the image information from an outside and output a printing result based thereon. The gradation sequence processor applies an error diffusion method and a dither method to the image information when the copying and the printing units output copying and printing results, respectively. The dither method has multiple types of dithering. Yet further, the start-up temperature is designated to be lower when one of the multiple types of a dither method is applied to the image information than when the error diffusion method is applied thereto. Further, an image formation condition changer is provided to change a condition of one of resolution of an image and the number of steps of a diameter of an image dot (to be generated based on the image information). The type of the dither method and the number of lines employed therein are changed in accordance with the image formation condition changed by the image formation condition changer. Further, a region detector is provided to detect (inclusion of) one of character and photographic regions on an image. The type of the dither method and the number of lines employed therein are changed in accordance with a detection result obtained by the region detector.

Numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus comprising:

an image information obtainer to obtain image information;

a gradation sequence processor to apply at least two different types of gradation sequence processing to the image information;

a toner image formation device to form a toner image on a recording medium based on the image information;

a fixing device to fix the toner image onto the recording medium in a fixing process;

a controller including a start-up temperature changer to change a start-up temperature of the fixing device during a start-up mode of the fixing device before the fixing process based on whether a halftone process is applied in the image information and a type of gradation sequence processing applied to the image information when the halftone process is applied; and a region detector to detect inclusion of one of character and photographic regions on an image, wherein if the halftone process is applied and the gradation sequence processor applies an error diffusion method, then the controller selects a first start-up temperature, wherein if the halftone process is applied and the gradation sequence processor applies a dither method, then the controller selects the first or a second start-up temperature, wherein if the halftone process is not applied, then the controller selects a third start-up temperature, wherein one of said at least two different types of gradation sequence processing includes at least two different types of dither method, wherein a type of a dither method applied and a respective number of lines employed by the dither method applied are changed in accordance with a detection result obtained by the region detector, wherein said start-up temperature is selected in accordance with the type of dither method applied to the image information and the respective number of lines employed by the dither method applied when one of the at least two different types of dither method is employed, wherein if a character region is included, halftone processing is applied and a speed priority general document mode is selected, then the controller selects the second start-up temperature, wherein if the character region is included, halftone processing is applied and the speed priority general document mode is not selected, then the controller selects the first start-up temperature, wherein if the character region is included, and halftone processing is not applied, but a photograph region is included, then the controller selects the third start-up temperature, wherein if the character region is included, and halftone processing is not applied and the photograph region is not included, then the controller selects the third start-up temperature, wherein if the character region is not included but the photograph region is included, and halftone processing is applied, then the controller selects the second start-up temperature, and wherein if the character region is not included, and either the photograph is region is not included or halftone processing is not applied, then the controller selects the third start-up temperature.

2. The image forming apparatus as claimed in claim 1, wherein said image information obtainer includes:

a copying unit to read the image information from an original document and output a copying result based thereon; and a printing unit to receive the image information from outside and output a printing result based thereon, wherein said gradation sequence processor applies said error diffusion method and said dither method to the image information when the copying and the printing units output copying and printing results, respectively, said dither method having at least two different types of dithering.

3. The image forming apparatus as claimed in claim 2, wherein said start-up temperature is set lower when one of the at least two different types of dither method is applied to the image information than when the error diffusion method is applied thereto.

4. The image forming apparatus as claimed in claim 1, further comprising:

an image formation condition changer to change an image formation condition, said image formation condition including resolution of an image and a number of steps of a diameter of an image dot to be generated based on the image information, wherein the type of a dither method applied and the respective number of lines employed by the dither method applied are changed in accordance with the image formation condition changed by the image formation condition changer.

5. The image forming apparatus as claimed in claim 1, wherein said fixing device includes:

a fixing unit to fuse the toner image onto the recording medium;

a pressing roller to press against the fixing unit and create a fixing nip thereat through which the recording medium passes; and an induction heater to apply induction heat to the fixing unit.

6. The image forming apparatus as claimed in claim 1, wherein said fixing device includes:

an endless fixing belt to fuse the toner image onto the recording medium;

a supporting unit to support an inner circumferential surface of the endless fixing belt;

a heater to heat the endless fixing belt;

a pressing unit to press against an outer surface of the endless fixing belt; and a nip creating unit to engage the pressing unit via the endless fixing belt and create a fixing nip thereat through which the recording medium passes.

7. The image forming apparatus as claimed in claim 1, wherein said fixing device includes:

a fixing unit to fuse the toner image on the recording medium thereto;

a pressing unit to press against the fixing unit and create a fixing nip thereat through which the recording medium passes; and a heater to heat at least one of the fixing unit and the pressing unit, wherein said heater is a planar heat generator formed from a flexible film and a resistive heat generator installed in the flexible film.

8. A method of forming an image, comprising the steps of:

obtaining image information;

determining whether a halftone process is applied in the image information;

applying one of at least two different types of gradation sequence processing to the image information based on determining whether the halftone process is applied;

forming a toner image based on the image information;

fixing the toner image on a recording medium using a fixing device;

changing a start-up temperature of the fixing device during a start-up mode before fixing the toner image based on determining whether the halftone process is applied in the image information and a type of gradation sequence processing applied to the image information when it is determined the halftone process is applied;

controlling a temperature of the fixing device to change the start-up temperature; and detecting one of character and photographic regions in an image, wherein if the halftone process and an error diffusion method are applied, the start-up temperature is a first start-up temperature, wherein if the halftone process and dither method are applied, the start-up temperature is the first or a second start-up temperature, wherein if a halftone process is not applied, the start-up temperature is a third start-up temperature, and wherein said step of applying one of at least two different types of gradation sequence processing includes applying a prescribed dither method to the image information; and changing a type of a dither method applied and a respective number of lines of the dither method applied in accordance with a detection result obtained from the regions in the detecting step, wherein said step of changing the start-up temperature of the fixing device before the fixing process includes selecting the start-up temperature further in accordance with the type of the dither method applied to the image information and the respective number of lines employed by the dither method applied.

9. The method as claimed in claim 8, wherein said step of applying one of at least two different types of gradation sequence processing includes applying one of at least two different types of said dither method, wherein said step of changing the start-up temperature of the fixing device before a fixing process includes selecting the start-up temperature in accordance with a type of a dither method applied to the image information and the respective number of lines employed by the dither method applied.

10. The method as claimed in claim 8, wherein said step of applying one of at least two different types of gradation sequence processing to the image information includes receiving image information from outside; and said method further comprising the step of:

printing the image information at the start-up temperature.

11. The method as claimed in claim 8, wherein said step of applying one of at least two different types of gradation sequence processing to the image information includes one of applying said error diffusion method to the image information when copying and applying one of at least two different types of dither method to the image information when printing, said method further comprising the step of:

setting the start-up temperature when the one of the at least two different types of dither method has been applied to the image information lower than when the error diffusion method has been applied thereto.

12. The method as claimed in claim 8, further comprising the step of:

changing an image formation condition including resolution of an image and a number of steps of a diameter of an image dot.

13. An image forming apparatus comprising:

means for obtaining image information;

means for applying at least two different types of gradation sequence processing to the image information;

means for forming a toner image based on the image information;

means for fixing the toner image onto a recording medium in a fixing process;

means for changing a start-up temperature of the fixing means during a start-up mode of the fixing means before the fixing process;

means for controlling a temperature of the fixing means to change the start-up temperature, and means for detecting inclusion of one of character and photographic regions in an image, wherein if a halftone process and an error diffusion method are applied, the start-up temperature is a first start-up temperature, wherein if the halftone process and dither method are applied, the start-up temperature is the first or a second start-up temperature, wherein if the halftone process is not applied, the start-up temperature is a third start-up temperature, wherein one of said at least two different types of gradation sequence processing includes at least two different types of dither method, wherein a type of a dither method applied and a respective number of lines employed by the dither method applied are changed in accordance with a detection result obtained by the region detecting means, wherein said start-up temperature is selected in accordance with the type of the dither method applied to the image information and the respective number of lines employed by the dither method applied when one of the at least two different types of dither method is employed, wherein if a character region is included, halftone processing is applied and a speed priority general document mode is selected, the start-up temperature is the first start-up temperature, wherein if the character region is included, halftone processing is applied and the speed priority general document mode is not selected, the start-up temperature is the second start-up temperature, wherein if the character region is included, and halftone processing is not applied, but a photograph region is included, the start-up temperature is the second start-up temperature, wherein if the character region is included, and halftone processing is not applied and the photograph region is not included, the start-up temperature is the third start-up temperature, wherein if the character region is not included but the photograph region is included, and halftone processing is applied, the start-up temperature is the second start-up temperature, and wherein if the character region is not included, and either the photograph is region is not included or halftone processing is not applied, the start-up temperature is the third start-up temperature.

14. The image forming apparatus as claimed in claim 13, wherein said image information obtaining means include:

means for reading the image information from an original document and outputting a copying result based thereon; and means for receiving the image information from an outside and outputting a printing result based thereon, wherein said gradation sequence processing means apply said error diffusion method and said dither method to the image information when the copying and printing means output copy and printing results, respectively, said dither method having at least two different types of dithering, and wherein said start-up temperature is set lower when one of the at least two different types of dither method is applied to the image information than when the error diffusion method is applied thereto.

15. The image forming apparatus as claimed in claim 13, further comprising:

means for changing an image formation condition including resolution of an image and number of steps of a diameter of an image dot to be generated based on the image information.

* * * * *